US010827263B2

(12) United States Patent
Christoph

(10) Patent No.: US 10,827,263 B2
(45) Date of Patent: Nov. 3, 2020

(54) ADAPTIVE BEAMFORMING

(71) Applicant: Harman Becker Automotive Systems GmbH, Karlsbad (DE)

(72) Inventor: Markus Christoph, Straubing (DE)

(73) Assignee: Harman Becker Automotive Systems GmbH (DE)

( * ) Notice: Subject to any disclaimer, the term of this patent is extended or adjusted under 35 U.S.C. 154(b) by 0 days.

(21) Appl. No.: 16/462,348

(22) PCT Filed: Nov. 17, 2017

(86) PCT No.: PCT/EP2017/079576
§ 371 (c)(1),
(2) Date: May 20, 2019

(87) PCT Pub. No.: WO2018/091648
PCT Pub. Date: May 24, 2018

(65) Prior Publication Data

US 2019/0320261 A1 Oct. 17, 2019

(30) Foreign Application Priority Data

Nov. 21, 2016 (EP) ..... 16199773

(51) Int. Cl.
*H04R 3/00* (2006.01)
*G10L 25/18* (2013.01)
(Continued)

(52) U.S. Cl.
CPC ..... *H04R 3/005* (2013.01); *G10L 21/0216* (2013.01); *G10L 25/18* (2013.01);
(Continued)

(58) Field of Classification Search
None
See application file for complete search history.

(56) References Cited

U.S. PATENT DOCUMENTS

2005/0141731 A1* 6/2005 Hamalainen ..... H01Q 3/2605 381/94.3
2011/0274291 A1* 11/2011 Tashev ..... G01S 3/86 381/94.1
(Continued)

FOREIGN PATENT DOCUMENTS

WO 2014154325 A1 10/2014

OTHER PUBLICATIONS

Sissi Xiaoxiao Wu et al: "Rank-two transmit beamformed Alamouti space-time coding for physical-layer multicasting", 2012 IEEE International Conference on Acoustics, Speech and Signal Processing (ICASSP 2012) : Kyoto, Japan, Mar. 25-30, 2012 ; [Proceedings), IEEE, Piscataway, NJ, Mar. 25, 2012 (Mar. 25, 2012), pp. 2793-2796, XP032227734, DOI: 10.1109/ICASSP.2012.6288497 ISBN: 978-1-4673-0045-2 the whole document.
(Continued)

*Primary Examiner* — James K Mooney
(74) *Attorney, Agent, or Firm* — Angela M. Brunetti

(57) ABSTRACT

A system and method for adaptive beamforming, which is configured to process at least two input signals and to provide an output signal, wherein a first input signal of the at least two input signals includes a desired signal as a main component and a second input signal of the at least two input signals, include an undesired signal as main component, includes adaptive error processing the second input signal and at least one of the first input signal and the output signal to provide an estimated undesired signal representative of an estimate of undesired signal components included in the first input signal, and taking the difference between the estimated undesired signal and the first input signal to provide the output signal.

18 Claims, 5 Drawing Sheets

(51) Int. Cl.

| | |
|---|---|
| ***G10L 25/84*** | (2013.01) |
| ***H04R 1/40*** | (2006.01) |
| ***G10L 21/0216*** | (2013.01) |
| ***H04R 1/22*** | (2006.01) |

(52) U.S. Cl.

CPC ..... *G10L 25/84* (2013.01); *H04R 1/222* (2013.01); *H04R 1/406* (2013.01); *G10L 2021/02166* (2013.01); *H04R 2430/25* (2013.01)

(56) References Cited

U.S. PATENT DOCUMENTS

| | | | | |
|---|---|---|---|---|
| 2012/0027218 | A1* | 2/2012 | Every | G10L 21/0208 381/66 |
| 2012/0224715 | A1 | 9/2012 | Kikkeri | |
| 2012/0239385 | A1 | 9/2012 | Hersbach et al. | |
| 2013/0287069 | A1 | 10/2013 | Su et al. | |
| 2014/0037100 | A1* | 2/2014 | Giesbrecht | G10K 11/002 381/71.8 |
| 2015/0317999 | A1 | 11/2015 | Gao | |
| 2017/0076720 | A1 | 3/2017 | Gopalan et al. | |
| 2018/0033447 | A1 | 2/2018 | Ramprashad et al. | |
| 2019/0104371 | A1 | 4/2019 | Ballande et al. | |

OTHER PUBLICATIONS

Abdel-Sainad A et al: Robust transmit eigen-beamforming based on imperfect channel state information, Smart Antennas, 2004. ITG Workshop on Munich, Germany Mar. 18-19, 2004, Piscataway, NJ, USA,IEEE Mar. 18, 2004 (Mar. 18, 2004), pp. 200-207, XP010780100, 001: 10. 1109/WSA.2004. 1407669 ISBN: 978-1-7803-8327-2 p. 201-p. 206.

* cited by examiner

ADAPTIVE BEAMFORMING

BACKGROUND

1. Technical Field

The disclosure relates to a system and method (generally referred to as a "system") for adaptive beamforming.

2. Related Art

Far field sound capturing allows, for example, recording sounds from a desired sound source positioned at a greater distance (e.g., several meters) from a far field microphone. The greater the distance between sound source and the far field microphone, however, the lower the desired sound to noise ratio will be. The term "noise" in the instant case includes sound that carries no information, ideas or emotions, e.g., no speech or music. Noise is commonly undesired and may be also referred to as interfering noise. When speech or music is introduced into a noise-filled environment such as a home or office interior, the noise present in the interior can have an undesired interfering effect on a desired speech communication or music presentation. Noise reduction is commonly the attenuation of undesired signals but may also include the amplification of desired signals. Desired signals may be speech or music signals, whereas undesired signals can be any sounds in the environment which interfere with the desired signals. There have been three main approaches used in connection with noise reduction: Directional beamforming, spectral subtraction, and pitch-based speech enhancement. Systems designed to receive spatially propagating signals often encounter the presence of interference signals. If the desired signal and interferers occupy the same temporal frequency band, then temporal filtering cannot be used to separate the desired signal from interference. There is a desire to improve noise reduction.

SUMMARY

An adaptive beamforming system is configured to process at least two input signals to provide an output signal, wherein a first input signal of the at least two input signals includes a desired signal as a main component and a second input signal of the at least two input signals includes an undesired signal as main component. The system includes an error extraction block configured to adaptively process the second input signal and at least one of the first input signal and the output signal to provide an estimated undesired signal representative of an estimate of undesired signal components included in the first input signal. The system further includes a subtractor configured to take the difference between the estimated undesired signal and the first input signal to provide the output signal.

An adaptive beamforming method is configured to process at least two input signals to provide an output signal, wherein a first input signal of the at least two input signals includes a desired signal as a main component and a second input signal of the at least two input signals includes an undesired signal as main component. The method includes adaptive error processing the second input signal and at least one of the first input signal and the output signal to provide an estimated undesired signal representative of an estimate of undesired signal components included in the first input signal. The method further includes taking the difference between the estimated undesired signal and the first input signal to provide the output signal.

Other systems, methods, features and advantages will be, or will become, apparent to one with skill in the art upon examination of the following detailed description and appended figures. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. In the Figures, like referenced numerals designate corresponding parts throughout the different views.

Figure 1:
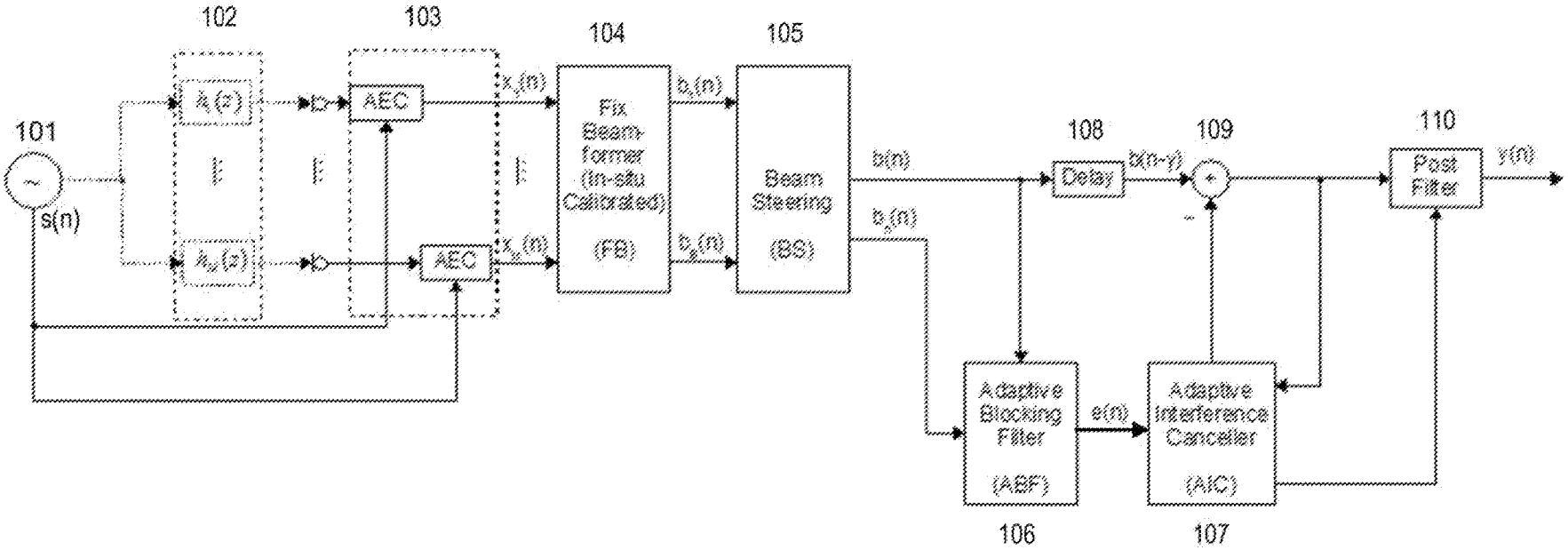
FIG. 1 is a schematic diagram illustrating an exemplary far field microphone system.

The Figures describe concepts in the context of one or more structural components. The various components shown in the figures can be implemented in any manner including, for example, software or firmware program code executed on appropriate hardware, software and any combination thereof. In some examples, the various components may reflect the use of corresponding components in an actual implementation. Certain components may be broken apart into plural sub-components and certain components can be implemented in an order that differs from that which is illustrated herein, including a parallel manner.

DETAILED DESCRIPTION

It has been found that desired signals and interfering signals often originate from different spatial locations. Therefore, beamforming techniques may be used to improve signal-to-noise ratios in audio applications. Common beamforming techniques include delay-sum techniques, adaptive finite impulse response (FIR) filtering techniques using algorithms such as the Griffiths-Jim algorithm, and techniques based on models of human binaural hearing.

Beamformers can be classified as either data independent or statistically optimum, depending on how the weights are chosen. The weights in a data independent beamformer do not depend on the array data and are chosen to present a specified response for all signal/interference scenarios. Statistically optimum beamformers select the weights to optimize the beamformer response based on statistics of the data. The data statistics are often unknown and may change with time so adaptive algorithms may be used to obtain weights that converge to the statistically optimum solution. Due to computational considerations, partially adaptive beamformers with arrays composed of large numbers of sensors may be used. Many different approaches have been proposed for implementing optimum beamformers. For example, the statistically optimum beamformer places nulls in the directions of interfering sources in an attempt to maximize the signal to noise ratio at the beamformer output.

In many applications the desired signal may be of unknown strength and may always be present. In such applications, a correct estimation of signal and noise covariance matrices in a maximum signal-to-noise ratio (SNR) is not possible. Lack of knowledge about the desired signal may prevent utilization of a reference signal approach. These limitations can be overcome through the application of linear constraints to the weight vector. Use of linear constraints is an approach that allows for extensive control over the adapted response of the beamformer. A universal linear constraint design approach does not exist and in many applications a combination of different types of constraint techniques may be effective. However, attempting to find either a single best way or a combination of different ways to design the linear constraint limits the use of techniques that rely on linear constraint design for beamforming applications.

Generalized sidelobe canceller (GSC) technology presents an alternative to a linear constraint design technique for beamforming applications. Essentially, GSC is a mechanism for changing a constrained minimization problem into unconstrained form. GSC leaves the desired signals from a certain direction undistorted, while, at the same time, undesired signals radiating from other directions are suppressed. However, GSC uses a two path structure; an upper path to realize a fix beamformer pointing to the direction of the desired signal, and a lower part that adaptively generates an ideally pure noise estimate, which can then be subtracted from the output signal of the fix beamformer, thus increasing its SNR by suppressing noise.

The estimation of the noise, is usually realized in a two-step approach. The first stage of the lower path is configured to remove remaining signal parts of the desired signal from the input signals of this stage. The second stage of the lower path further comprises M (M is an integer) adaptive interference cancellers (AIC) in order to generate a single-channel, estimated noise signal, which can possibly then be subtracted from the output signal of the upper path, which is a time delayed output signal of the fix beamformer. Thus, the noise contained in the output signal of the time delayed fix beamformer can be suppressed, leading to a better SNR, as the desired signal component ideally would not be affected by this processing. This holds true if and only if all desired signal parts within the noise estimation could successfully be united, which is rarely the case in practice, and which thus represents one of the major drawbacks related to current adaptive beamforming algorithms.

Acoustic echo cancellation may be attained, e.g., by subtracting an estimated echo signal from the total sound signal. To provide an estimate of the actual echo signal, algorithms may operate in the time domain that may employ adaptive digital filters processing time-discrete signals. Such adaptive digital filters operate in such a way that the network parameters defining the transmission characteristics of the filter are optimized with reference to a preset quality function. Such a quality function may be implemented, for example, by minimizing the average square errors of the output signal of the adaptive network with reference to a reference signal.

Referring to FIG. 1, in an exemplary far field microphone system, sound from a desired sound source 101 is radiated via one or a plurality of loudspeakers, travels through the room, where it is filtered with the corresponding room impulse responses (RIRs) 102 and may possibly be corrupted by noise before the corresponding signals are picked up by one or more (M) microphones. The far field microphone system shown in FIG. 1 includes an acoustic echo cancellation (AEC) block 103, a subsequent fix beamformer (FB) block 104, a subsequent beam steering block 105, a subsequent adaptive blocking filter (ABF) block 106, a subsequent adaptive interference canceller (AIC) block 107, and a subsequent optional adaptive post filter block 110. ABF block 106, AIC block 107, optional delay block 108, and subtractor 109 form an adaptive beamformer block.

Figure 2:
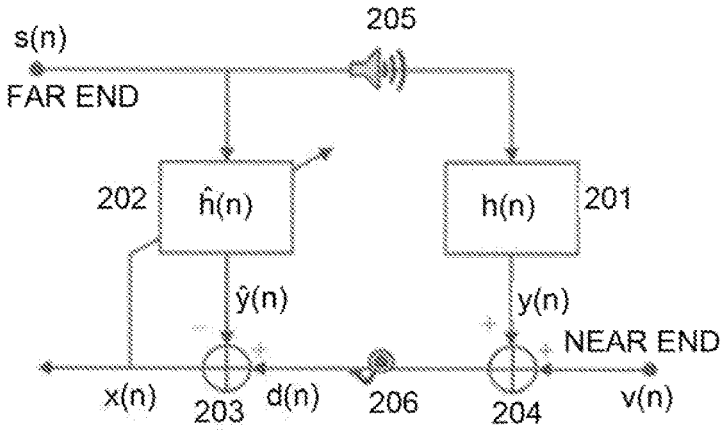
FIG. 2 is a schematic diagram illustrating an exemplary acoustic echo canceller applicable in the far field microphone system shown in FIG. 1.

As can be seen from FIG. 1, N source signals, filtered by RIRs 102 having transfer functions h{n, 1}, . . . h{n,M}, and possibly overlaid by noise, serve as an input to the AEC block 103. FIG. 2 depicts an exemplary realization of the single microphone, single loudspeaker AEC block 103. As would be understood and appreciated by those skilled in the art, such a configuration can be extended to include more than one microphone 206 and/or more than one reference signal (loudspeaker). A far end signal or source signal s(n) radiated by a loudspeaker 205 (or a plurality of loudspeakers) passes through an (at least one) echo path 201 having a transfer function vector h(n) to form an echo signal y(n), wherein n is a (discrete) time index. This signal is added in an acoustic domain at a summing node 204 to a near-end signal v(n) which may contain both background noise and near-end speech, resulting in a microphone signal d(n) in the electrical domain. An estimated echo signal from an adaptive filter 202 which defines a vector is subtracted from the microphone signal d(n) at a subtracting node 203. A goal of the adaptive filter 202 is to minimize an error signal x(n), by subtracting an estimate $\hat{y}(n)$ of the echo signal y(n) from the microphone signal d(n) at subtracting node 203.

A FIR filter 202 that has a transfer function $\hat{h}(n)$ of order L−1, wherein L is a length of the FIR filter, may be used to model the echo path transfer function vector h(n). The transfer function vector $\hat{h}(n)=h(n)$ can be described as $$[h(0,n), \ldots h(L-1,n),]^T$$

The desired microphone signal d(n) at block 203 for the adaptive filter is given as $$d(n)=s^T(n)h(n)+v(n),$$

wherein $s(n)=[s(n)s(n-1) \ldots s(n-L+1)]^T$ is a real-valued vector containing L (L is an integer) most recent time samples of the input signal, s(n), and v(n), i.e., the near-end signal.

Using the previous notations, the feedback/echo error signal x(n) is given as $$x(n)=d(n)-s^T(n-1)\hat{h}(n)=s^T(n)[h(n)-\hat{h}(n)]+v(n),$$

wherein the vector $\hat{h}(n)$ contains adaptive filter coefficients at time n. Vector $\hat{h}(n)$ is estimated using e.g. a Least Mean Square (LMS) algorithm or any state-of the art recursive algorithm. The LMS update process using a step size of μ(n) of the LMS-type algorithm can be expressed as $$\hat{h}(n)=\hat{h}(n-1)+\mu(n)s(n)x(n).$$

Figure 3:
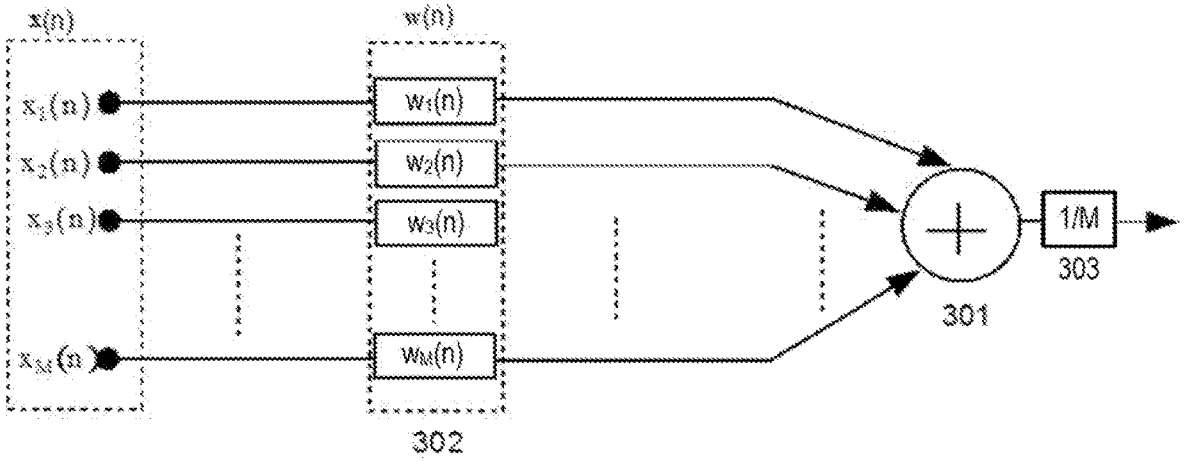
FIG. 3 is a schematic diagram illustrating an exemplary filter-and-sum beamformer.

Referring again to FIG. 1, the output of AEC block 103 serves as an input $x_i(n)$, with i=1, . . . , M, to the fix beamformer block 104. Simple yet effective beamforming techniques are, for example, the filter-and-sum (FS) technique and the delay-and-sum (DS) technique. A simple FS beamformer structure such as in fix FS beamformer block 104 is shown in FIG. 3, whose output is given as $$b_i(n) = \frac{1}{M}\sum_{i=1}^{M} x_i(n)\cdot w_i(n),$$

wherein M is again the number of microphones. The FS beamformer block 104 may include a summer 301 which receives signals $x_i(n)$ from AEC block 103 via filter paths 302 having transfer functions w(n) and a coefficient element 303 which divides the output signal of summer 302 by M to generate an output signal of the FS beamformer block 104. Further output signals of FS beamformer block 104 are derived accordingly with different transfer functions w(n). A DS beamformer can be implemented by choosing $w_i(n)$ according to $w_i(n)=e^{-j2\pi f\tau_i}$, in which f is a frequency and $\tau_i$ is a delay time.

In FIG. 1, the output signals of the fix FS beamformer block 104 serve as beam signals $b_i(n)$, wherein i=1, 2, . . . B, and are input into beam steering (BS) block 105. Each signal output by the fix FS beamformer block 104 represents an acoustic signal (sound) picked-up from a different room direction and may have a different SNR level. The fix FS beamformer block 104 is optional and can be omitted if microphones that pick up the acoustic signals (sound) provide sufficient directivity. The beam signals $b_i(n)$ input into the beam steering block 105 may contain low frequency components such as low frequency rumble, direct current (DC) offsets and unwanted vocal plosives in case of speech signals. Therefore, these artifacts that may impinge on the beam signals $b_i(n)$ of the BS block 105 are desired to be removed.

Figure 4:
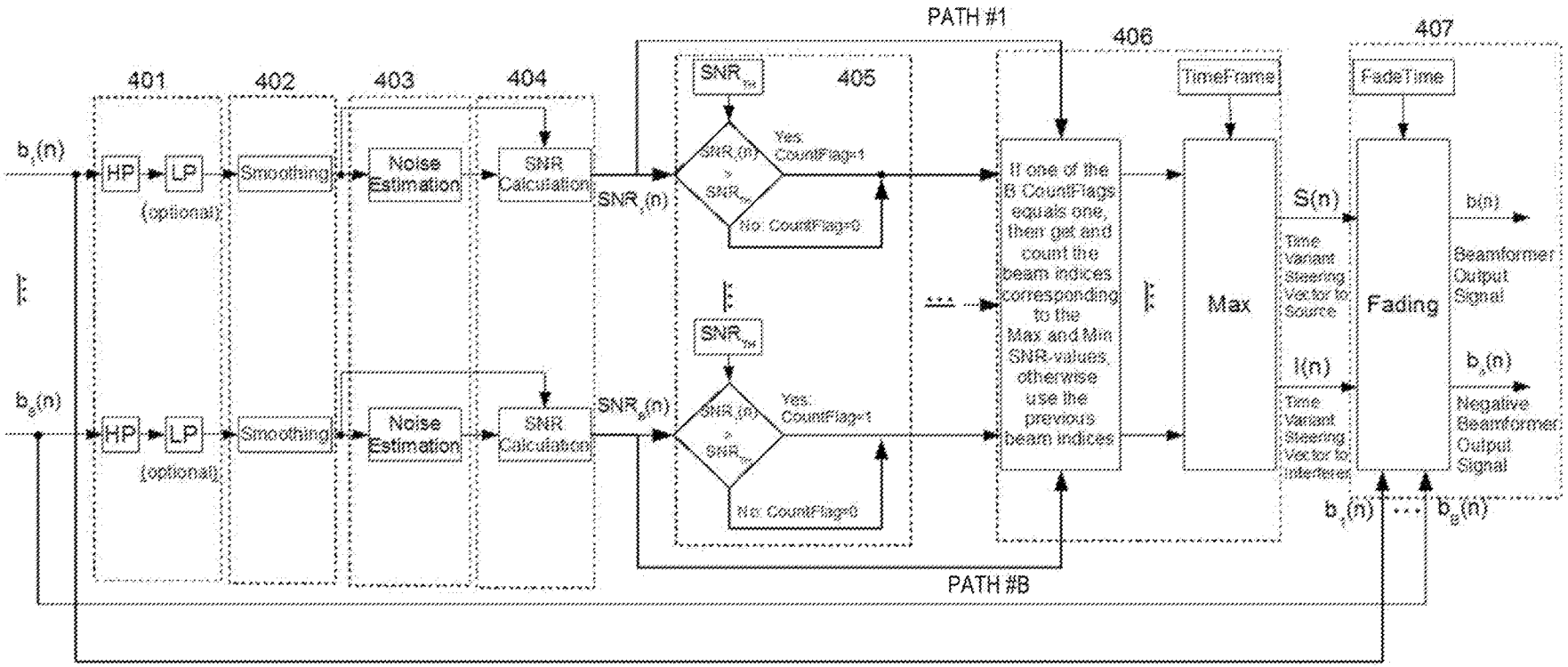
FIG. 4 is a schematic diagram illustrating an exemplary beamsteering unit operated in the time domain.

Referring to FIG. 4, in an exemplary beamsteering block operated in the time domain, which is applicable as beamsteering block 105 in the system shown in FIG. 1 or in any other appropriate system, the beam signals $b_i(n)$ are high pass and optionally low pass filtered by way of a filter block 401 in order to block signal parts that are either affected by noise or do not contain parts of the useful signal (e.g., a speech signal). Signals output by filter block 401 may have amplitude variations due to noise, e.g., rapid, random changes in amplitude from point to point in the beam signals $b_i(n)$. In this situation, it may be useful to reduce noise contained in these signals, e.g., by way of a (temporal) smoothing block 402. Smoothing may be performed by, e.g., a low pass IIR filter (not shown) in smoothing block 402, which reduces the high frequency components and passes the low-frequency components with little or no change. Acquisition points in output signals of the smoothing block 402 are modified in a way that individual points with higher amplitudes than their immediately adjacent points (presumably because of noise) are reduced, and points with lower amplitude than their immediately adjacent points are increased. This leads to a smoother signal (and a slower step response to signal changes).

The smoothing block 402 outputs a smoothed signal that may still contain a considerable level of noise and thus, may cause noticeable sharp discontinuities as described above. The level of voice signals typically differs distinctly from the variation of the level of background noise, particularly due to the fact that the dynamic range of the level changes of voice signals is significantly greater and the level changes occur in much shorter intervals than the level changes of background noise. Linear smoothing in a noise estimation block 403 following the smoothing block 402 would therefore smear out the sharp variation in the desired music or voice signal as well as filter out the noise. Such smearing of a music or voice signal is not desired in many applications, therefore, alternatively or additionally, non-linear smoothing (not shown) in noise estimation block 403 may be applied to the smoothed signal to overcome the artifacts mentioned above. The noise estimation block 403 outputs signals representative of estimates of the noise contained in the corresponding output signals of smoothing block 402.

Figure 6:
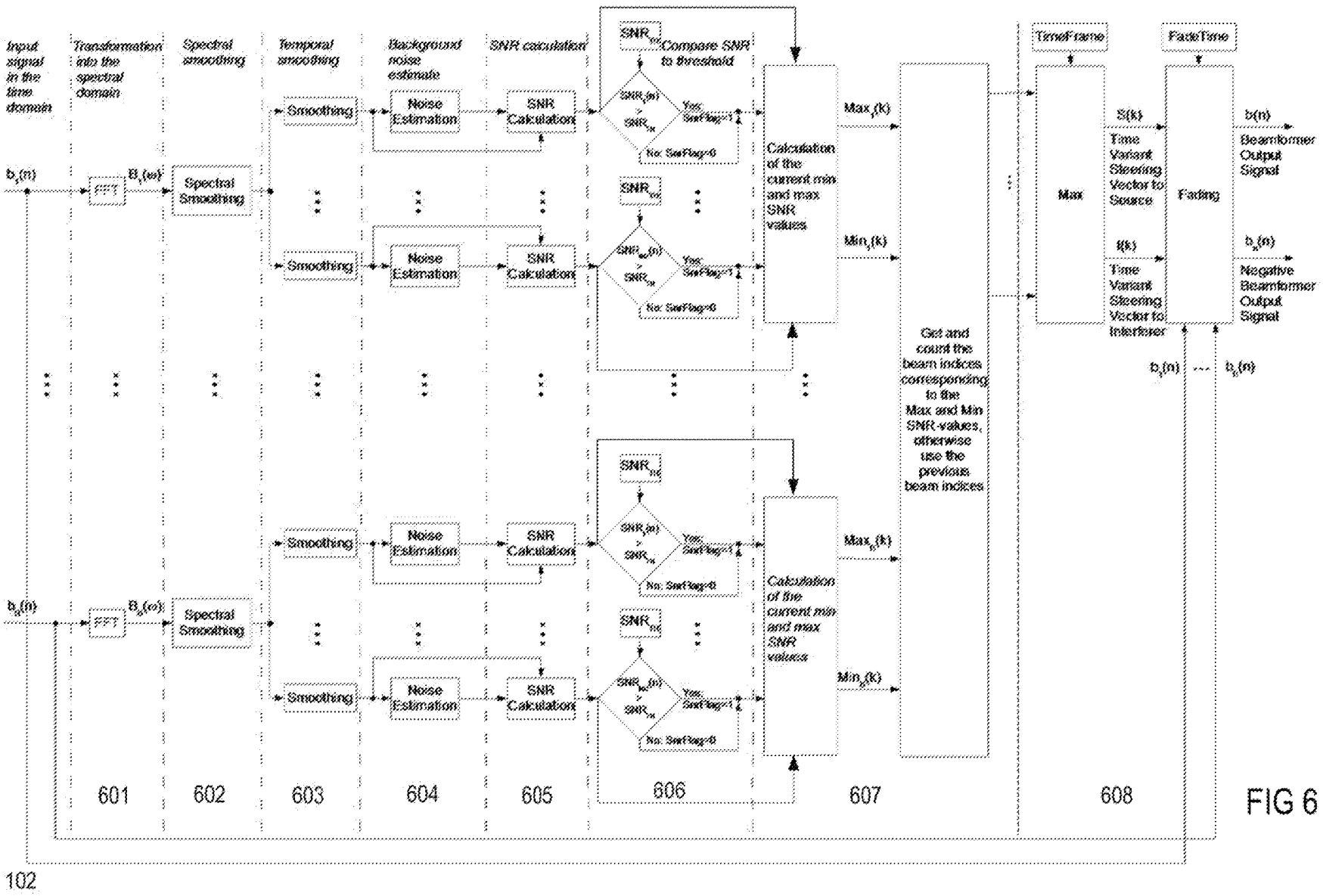
FIG. 6 is a schematic diagram illustrating another exemplary beamsteering unit operated in the frequency domain.

In an SNR calculation block 404, based on the smoothed signals from smoothing block 402 and the estimated background noise signals from noise estimation block 403, variations of the respective SNR are evaluated and output as, e.g., a distribution of each of SNR values $SNR_1(n)$ . . . $SNR_B(n)$ over time n for a corresponding beam 1 . . . B. The evaluation and, thus, the distribution may extend over a certain time period, i.e., a frame or time window, such as from n to n−100 or the like. By evaluating variations in the SNR, a noise source can be differentiated from a desired speech or music signal. For example, low SNR values may represent a variety of noise sources such as an air-conditioner, fan, an open window, or an electrical device such as a computer etc. The SNR values $SNR_1(n)$ . . . $SNR_B(n)$ may be determined in a time domain (as shown in FIG. 4) or in a frequency domain (as shown in FIG. 6) or in a sub-band frequency domain (not shown) by SNR calculation block 404.

In a subsequent comparator block 405, the SNR values $SNR_1(n)$ . . . $SNR_B(n)$ output by block 404 are compared to pre-determined thresholds. The thresholds may be fix or controllable, frequency dependent or independent etc. If the current SNR value exceeds a corresponding pre-determined threshold, a flag indicating a desired signal such as speech will be set to a first logic value, e.g., '1'. Alternatively, if the current SNR value is less than a corresponding pre-determined threshold, a flag indicating an undesired signal such as noise from an air-conditioner, fan, an open window, or an electrical device such as a computer will be set to a second logic value, e.g., '0'. In the present example, all thresholds have the same value $SNR_{TH}$.

SNR values $SNR_1(n)$ . . . $SNR_B(n)$ from block 404 and the flags from comparator block 405 are passed on to a controller block 406 via paths #1 . . . # B. The controller block 406 counts the number of logic values "1", i.e. when SNR signals exceed the threshold $SNR_{TH}$, over a certain time period (frame, window) which may be adjustable by a parameter "TimeFrame" for all B beams. Thereby, a histogram is created for those SNR values per beam over the certain time period defined by the tunable parameter "TimeFrame". For each frame, the sum or count over all logic values "1" for each of the B beams, which represent distinct (horizontal) directions of the sound, is determined. The direction of the B beams that has the highest (maximum or "Max") count of logic values "1" in this frame will be considered as a positive beam, pointing to the desired signal source, e.g., a speaker. The corresponding indices identifying a time variant direction of the positive beam (its steering vector or look direction) to a desired source will be output, referred to as signal S(n). The signal S(n) is fed into a fading block 407 which prevents acoustical artifacts, such as clicks that occur when switching between beams, by fading (soft switching) between beams.

The concept described above (counting "0" values) may have some drawbacks when applied to the determination of indices of a negative beam, which ideally should point in the direction of a potential noise source, in the event of low SNR values of all B beam signals. In such a case, each of the B beam signals that have the lowest SNR may also be indicated with a logic value "1" (by inverting the logic value "0"

used so far), and a histogram, defined by the same, adjustable "TimeFrame" parameter, may again be compiled over time. This means that the controller block 406 counts the number of logic values "1", i.e. the number of indices (look directions) that have, over a certain time period (frame, window), the lowest SNR values which may be adjustable by a parameter "TimeFrame" for all B beams. Then again, the maximum of this histogram would also indicate the indices (steering vector, look direction) of the negative beam that point to a noise source.

If no distinct solution can be found or none of the B beams meet the given requirements, then the previous indices (look direction) for the positive and/or negative beam are applied. Similarly to signal S(n), the indices of the negative beam are also supplied to the fading block 407 as time varying signal I(n). Again, fading block 407 ensures that the final output signal of the identified negative beam does not suffer from acoustical artifacts, similarly to the positive beam signal. For example, a histogram of the maximum and minimum values may be compiled for a pre-determined time duration. The minimum and maximum values in a histogram are representative of at least two different output signals: at least one signal is directed towards a desired source denoted by signal S(n) and at least one signal is directed towards an interference source denoted by signal I(n).

If indices of low and high SNR values in controller block 406 change over time, a fading process is initiated in a fading block 407 that allows a smooth transition from one to the other output signal, without generating acoustic artifacts. Referring again to FIG. 1, the outputs of the BS block 105 represent positive and negative beams selected over time, in which a positive beam indicates a beam having the highest SNR and a negative beam indicates a beam having the lowest SNR.

The outputs of BS block 105 provide a signal with a high SNR, i.e., a positive beam signal b(n), which is used as a reference signal by the adaptive blocking filter (ABF) block 106 and one with a low SNR, i.e., a negative beam $b_n(n)$, used as a desired noise signal (further input signal) by the ABF block 106. The ABF filter block 106 may use filters controlled according to an LMS algorithm to adaptively subtract the signal of interest, represented by the reference signal b(n) (corresponding to the positive beam) from the desired noise signal $b_n(n)$ (corresponding to the negative beam) and provides an error signal e(n). The error signal e(n) obtained from the ABF block 106, which ideally is a pure noise signal also included in the positive beam signal b(n), is passed to the adaptive interference canceller (AIC) block 107 which adaptively removes the signal components (noise) contained in the positive beam signal b(n) that are correlated to the error signals, i.e., to the positive beam signal b(n).

AIC block 107 computes an interference signal employing adaptive filtering. The output of this adaptive filter is subtracted (e.g., by way of a subtractor 109) from the optionally delayed (e.g., by way of delay 108) reference signal b(n) to eliminate the remaining interference and noise components in the reference signal b(n). Finally, an adaptive post filter 110 may be connected to an output of subtractor 109 for the reduction of statistical noise components (not having a distinct autocorrelation). As in the block 106, the filter coefficients in the AIC block 107 may be updated using the adaptive LMS algorithm. The norm of the filter coefficients in the ABF block 106 and/or AIC block 107 may be constrained to prevent them from growing excessively large.

Figure 5:
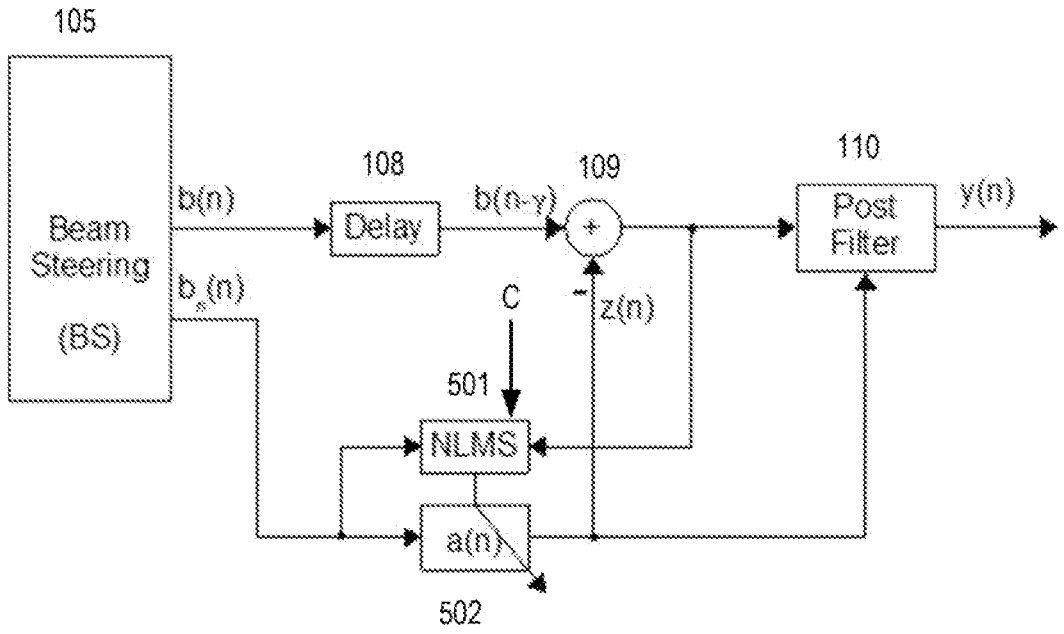
FIG. 5 is a schematic diagram illustrating a simplified structure of an adaptive beamformer operated in the time domain with adaptive blocking filter and post filter.

FIG. 5 illustrates an exemplary adaptive beamformer for eliminating noise from the reference signal, i.e., positive beam signal b(n). Thereby, the noise components included in the reference signal b(n), denoted z(n) in FIG. 5, will be estimated by an adaptive filter controller 501 and subtracted by subtractor 109 from the optionally delayed (by way of delay 108) desired noise signal b(n−y) to reduce to a certain extent, by way of a controllable filter 502 with a transfer function a(n), undesired noise contained in the reference signal b(n). As a reference signal for the adaptive filter controller 501, the negative beam signal $b_n(n)$, which ideally only contains noise and no useful signals such as speech, is used. A normalized least mean square (NLMS) algorithm or any other appropriate adaptive algorithm may be employed to estimate noise in the desired signal, i.e., negative beam signal $b_n(n)$, which is subtracted from the optionally delayed reference signal b(n−y) to reduce noise still contained in the reference signal b(n). The desired noise signal $b_n(n)$ will be used as g noise reference signal for adaptive filter controller 501 to eliminate any residual noise in the reference signal b(n). This will in turn increase the SNR of the reference signal b(n).

The adaptive filter controller 501 and the controllable filter 502 constitute an exemplary adaptive blocking filter which may employ, as in the present example, a constraint C so that a magnitude frequency response, e.g., the magnitude of the transfer function a(n), of the adaptive blocking filter does not exceed a predetermined value at any frequency and at any time. For example, the constraint C may limit, in the time domain, filter coefficients of the adaptive blocking filter to a predetermined value such as +/−1. Alternatively, a constraint may be implemented in the frequency domain according to $$[U,V]=\text{find}(\text{abs}(A)>\text{Max } A_{Lim}),$$

$$A(U)=A(U)/\text{abs}(A(U)),$$

$$\text{Max } A_{Lim}=1,$$

wherein U is a parameter representing frequencies at which the constraint is to be applied, V is a parameter representing amplitudes at the frequencies U, A is the transfer function of the adaptive blocking filter in the frequency domain, and $\text{Max}A_{Lim}$ is the predetermined maximum value of the transfer function.

Referring to FIG. 6, in another exemplary beamsteering block applicable in beamsteering block 105 in the system shown in FIG. 1 or in any other appropriate system, beam signals $b_1(n) \ldots b_B(n)$ may be transformed from the time domain into the frequency (i.e., spectral) domain by way of a time-frequency transformation block 601. Accordingly, the beamsteering block shown in FIG. 6 is operated in the frequency (spectral) domain. The spectral components of the beam signals $b_1(n) \ldots b_B(n)$ can be obtained by a variety of ways, including band pass filtering and Fourier transformation. For example, a discrete Fourier transform (DFT) or fast Fourier transform (FFT) may be used to transform sequential blocks of $N_{RECORD}$ acquisition points of the input signal. A window function, such as a Hanning window, and an overlap of, e.g., $N_{RECORD}/2$ points may be applied. DFT may be used at each frequency bin in the input signal. Alternatively, FFT can be used over the whole frequency band occupied by the input signal. The spectrum is recorded for each frequency bin within the input signal band.

Frequency range and resolution on a frequency axis of a spectrum graph depend on a sampling rate $f_{SAMPLE}$ and the size of the data record (the number $N_{RECORD}$ of acquisition points). The number of frequency points or lines or bands in the (power) spectrum is $N_{RECORD}/2$, where $N_{RECORD}$ is the number of signal points captured in the time domain. The first frequency line in the power spectrum represents a frequency of zero (DC). The last frequency line can be found at $f_{SAMPLE}/2$. Frequency lines are spaced at even intervals of $f_{SAMPLE}/N_{RECORD}$. They are commonly referred to as frequency bins or FFT bins.

In the example shown in FIG. 6, time-frequency transformation block 601 applies FFT with optional windowing (not shown) to time domain beam signals $b_1(n) \ldots b_B(n)$ to generate beam signals $B_1(\omega) \ldots B_B(\omega)$ in the frequency domain. Each of the beam signals $B_1(\omega) \ldots B_B(\omega)$ is optionally smoothed by a spectral smoothing block 602, e.g., using a moving average filter of appropriate length and applying a window function. For the window function, a Hanning window or any other appropriate window function may be used.

The (optional) spectral smoothing of each of the beam signals $B_1(\omega) \ldots B_B(\omega)$ results in a number of frequency bins that may deteriorate the total spectral resolution. In order to reduce this effect, each spectrally smoothed signal, i.e., each output signal of the spectral smoothing block 602, may further be smoothed by way of a temporal smoothing block 603 for every bin of each of the beam signals $B_1(\omega) \ldots B_B(\omega)$. The temporal smoothing block 603 is employed to smear out impulsive distortions such as speech in the spectrally smoothed signals, and may combine frequency bins over time for each output signal of the spectral smoothing block 602 to reduce the temporal dynamics in these signals.

The temporal smoothing block 603 outputs for each of the output signals of spectrally smoothing block 602 one or more additionally temporally smoothed signals, (herein referred to as smoothed signals) that may still contain impulsive distortions as well as background noise. A noise estimation block 604, which is coupled to outputs of the temporal smoothing block 603, is employed to smear out remaining impulsive distortions and to estimate the current background noise in each output signal of the temporal smoothing block 603 (smoothed signal) derived from each output signal of the spectral smoothing block 602 (spectrally smoothed signal). In order to reduce or avoid smearing of a desired signal such as music or voice signals, non-linear smoothing (not shown) may be employed in noise estimation block 604.

Based on the smoothed signals from temporal smoothing block 603 and the estimated quasi stationary background noise signal from noise estimation block 604, variations in SNR can be calculated (e.g., as a distribution of SNR values over frequency). In an SNR calculation block 605, for each output signal of noise estimation block 604 in connection with the corresponding output signal from temporal smoothing block 603 an SNR value is computed. Due to variations in the SNR, a noise source can be differentiated from a desired speech or music signal. For example, a low SNR value may represent a variety of noise sources such as an air-conditioner, fan, an open window, or an electrical device such as a computer etc. The SNR may be evaluated in the time domain or in the frequency domain or in the sub-band domain.

In a comparator block 606, each spectral line of each SNR value $SNR_1(n) \ldots SNR_B(n)$ provided by SNR calculation block 605 is compared to a mutual (or individual) pre-determined threshold $SNR_{TH}$. If the respective current SNR value $SNR_1(n) \ldots SNR_B(n)$ is greater than the pre-determined threshold $SNR_{TH}$, a flag SnrFlag, which may indicate a desired speech signal, will be set to a first logic value of, e.g., '1'. If the respective current SNR value $SNR_1(n) \ldots SNR_B(n)$ is less than the pre-determined (alternatively, controllable and/or spectrally dependent) threshold $SNR_{TH}$, the flag SnrFlag will be set per spectral line to a second logic value of, e.g., '0' to indicate an undesired signal such as noise from an air-conditioner, fan, an open window, or an electrical device such as a computer.

The flags SnrFlag from block 606 are passed on to a min max block 607. The min max block 607 determines, for each of beam signals $B_1(\omega) \ldots B_B(\omega)$, from all flags SnrFlag related to the respective one of beach signals $B_1(\omega) \ldots B_B(\omega)$ and the corresponding SNR values the corresponding minimum SNR values $Min_1(k) \ldots Min_B(k)$ and maximum SNR values $Max_1(k) \ldots Max_B(k)$, in which k represents a discrete time. The min max block 607 further counts beam indices 1 . . . B corresponding to the minimum SNR values $Min_1(k) \ldots Min_B(k)$ and beam indices 1 . . . B corresponding to the maximum SNR values $Max_1(k) \ldots Max_B(k)$ and, if counting is not possible, uses a previous distribution of beam indices. For this, a histogram of the maximum and minimum SNR values may be compiled for a pre-determined time period. The minimum and maximum SNR values in a histogram are representative of at least two different output signals. At least one signal is directed towards a desired source denoted by a time variant steering vector S(n) and at least one signal is directed towards an interference source denoted by a time variant steering vector I(n).

A fader block 608 receives the steering vectors S(n) and I(n) and the signals $b_1(n) \ldots b_n(n)$ and provides the reference signal, i.e., the positive beam signal b(n), and the desired signal, i.e., the negative beam signal $b_n(n)$. If the indices of low and high SNR values in the min max block 607 change over time, a fading process is initiated in a fader block 608 that allows a smooth transition between its output signal(s), without generating acoustic artifacts. The output signals of the min max block 607, the reference signal b(n) and the desired signal $b_n(n)$, are the positive beam signal b(n) and the negative beam signal $b_n(n)$ over discrete time n.

Referring back to FIGS. 4 and 6, a negative beam may alternatively be established by setting its direction to be in a certain angle with respect to the positive beam. For example, when the look direction of the positive beam has been determined, the look direction of the negative beam may be set to an angle of 180° (i.e., opposite of the look direction of the positive beam) or any other appropriate angle.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third,"

etc. are used merely as labels, and are not intended to impose numerical requirements or a particular positional order on their objects.

The embodiments of the present disclosure generally provide for a plurality of circuits, electrical devices, and/or at least one controller. All references to the circuits, the at least one controller, and other electrical devices and the functionality provided by each, are not intended to be limited to encompassing only what is illustrated and described herein. While particular labels may be assigned to the various circuit(s), controller(s) and other electrical devices disclosed, such labels are not intended to limit the scope of operation for the various circuit(s), controller(s) and other electrical devices. Such circuit(s), controller(s) and other electrical devices may be combined with each other and/or separated in any manner based on the particular type of electrical implementation that is desired.

It is recognized that any computer, processor and controller as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any controller as disclosed utilizes any one or more microprocessors to execute a computer-program that is embodied in a non-transitory computer readable medium that is programmed to perform any number of the functions as disclosed. Further, any controller as provided herein includes a housing and the various number of microprocessors, integrated circuits, and memory devices (e.g., FLASH, random access memory (RAM), read only memory (ROM), electrically programmable read only memory (EPROM), electrically erasable programmable read only memory (EEPROM)) positioned within the housing. The computer(s), processor(s) and controller(s) as disclosed also include hardware based inputs and outputs for receiving and transmitting data, respectively from and to other hardware based devices as discussed herein.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

The invention claimed is:

1. An adaptive beamforming system configured to process at least two input signals to provide an output signal, wherein a first input signal of the at least two input signals includes a desired signal as a main component and a second input signal of the at least two input signals includes an undesired signal as a main component, the system comprising:

an error extraction block configured to adaptively process the second input signal and at least one of the first input signal and the output signal to provide an estimated undesired signal representative of an estimate of undesired signal components included in the first input signal;

a subtractor configured to take a difference between the estimated undesired signal and the first input signal to provide the output signal;

a beamforming block configured to process two or more microphone signals to provide one or more beam signals; and a beamsteering block configured to process the one or more beam signals, wherein processing the one or more beam signals comprises detecting the desired signal and the undesired signal from the one or more beam signals, the desired signal representative of a beam of sound waves pointing towards a desired source, and the undesired signal representative of a beam of sound waves pointing towards a noise source.

2. The system of claim 1, wherein the error extraction block employs a magnitude transfer function and further comprises a constraint that is configured to limit the magnitude transfer function to a predetermined maximum magnitude.

3. The system of claim 1, further comprising a delay block configured to timely delay the first input signal before determining the difference with the estimated undesired signal.

4. The system of claim 1, wherein the error extraction block comprises at least one of an adaptive blocking filter and an adaptive interference canceller block, the adaptive blocking filter being configured to block desired signal components contained in the second input signal and the adaptive interference canceller block being configured to eliminate desired signal components from the second input signal.

5. The system of claim 1, wherein processing the one or more input signals further comprises evaluating signal-to-noise ratios of the one or more beam signals, and detecting the desired signal as that having the highest signal-to-noise ratio and the undesired signal as that having the lowest signal-to-noise ratio from the one or more beam signals.

6. The system of claim 1, wherein the beamforming block is a fix beamformer.

7. An adaptive beamforming method configured to process at least two input signals to provide an output signal, wherein a first input signal of the at least two input signals includes a desired signal as a main component and a second input signal of the at least two input signals includes an undesired signal as a main component; the method carried out by a processor having a non-transitory computer-readable storage medium capable of executing instructions, the method comprising the steps of:

adaptive error processing the second input signal and at least one of the first input signal and the output signal to provide an estimated undesired signal representative of an estimate of undesired signal components included in the first input signal;

taking a difference between the estimated undesired signal and the first input signal to provide the output signal;

beamforming processing two or more microphone signals to provide one or more beam signals; and beamsteering processing the one or more beam signals, wherein processing the one or more beam signals further comprises detecting the desired signal and the undesired signal from the one or more beam signals, the desired signal representing a beam of sound wave pointing towards a desired source, and the undesired signal representing a beam of sound wave pointing towards a noise source.

8. The method of claim 7, wherein adaptive error processing employs a magnitude transfer function and further comprises a constraint that is configured to limit the magnitude transfer function to a predetermined maximum magnitude.

9. The method of claim 7, further comprising timely delaying the first input signal before determining the difference with the estimated undesired signal.

10. The method of claim 7, wherein adaptive error processing further comprises at least one of an adaptive blocking filtering and an adaptive interference cancelling, the adaptive blocking filtering configured to block desired signal components contained in the second input signal and the adaptive interference cancelling configured to eliminate desired signal components from the second input signal.

11. The method of claim 1, wherein processing the one or more beam signals further comprises evaluating signal-to-noise ratios of the one or more beam signals, and detecting the desired signal as that having the highest signal-to-noise ratio and the undesired signal as that having the lowest signal-to-noise ratio from the one or more beam signals.

12. The method of claim 1, wherein processing the one or more beam signals by beamforming further comprises fix beamforming.

13. A non-transitory computer-readable storage medium comprising instructions which, when executed by a computer, performs an operation for adaptive beamforming configured to process at least two input signals to provide an output signal, the first input signal of the at least two input signals includes a desired signal as a main component and a second input signal of the at least two input signals includes an undesired signal as a main component, the operation comprising:

adaptive error processing the second input signal and at least one of the first input signal and the output signal to provide an estimated undesired signal representative of an estimate of undesired signal components included in the first input signal;

taking a difference between the estimated undesired signal and the first input signal to provide the output signal;

beamforming processing two or more microphone signals to provide one or more beam signals; and beamsteering processing the one or more beam signals, wherein processing the one or more beam signals comprises detecting the desired signal and the undesired signal from the one or more beam signals, the desired signal representing a beam of sound wave pointing towards a desired source, and the undesired signal representing a beam of sound wave pointing towards a noise source.

14. The non-transitory computer-readable storage medium as claimed in claim 13, wherein adaptive error processing employs a magnitude transfer function and further comprises a constraint that is configured to limit the magnitude transfer function to a predetermined maximum magnitude.

15. The non-transitory computer-readable storage medium as claimed in claim 13, further comprising timely delaying the first input signal before determining the difference with the estimated undesired signal.

16. The non-transitory computer-readable storage medium instructions as claimed in claim 13, wherein adaptive error processing comprises at least one of an adaptive blocking filtering and an adaptive interference cancelling, the adaptive blocking filtering configured to block desired signal components contained in the second input signal and the adaptive interference cancelling configured to eliminate desired signal components from the second input signal.

17. The non-transitory computer-readable storage medium as claimed in claim 13, wherein processing the one or more beam signals further comprises evaluating signal-to-noise ratios of the one or more beam signals, and detecting the desired signal as that having the highest signal-to-noise ratio and the undesired signal as that having the lowest signal-to-noise ratio from the one or more beam signals.

18. The non-transitory computer-readable storage medium of claim 13, wherein processing the one or more beam signals by beamforming comprises fix beamforming.

* * * * *